United States Patent [19]
Amano et al.
[11] 4,433,650
[45] Feb. 28, 1984

[54] SYSTEM FOR CONTROLLING THE STARTING OPERATION OF AN INTERNAL COMBUSTION ENGINE

[75] Inventors: Matsuo Amano; Takao Teranishi, both of Hitachi; Yasunori Mouri; Osamu Abe, both of Katsuta; Takao Sasayama, Hitachi, all of Japan

[73] Assignee: Hitachi, Ltd., Tokyo, Japan

[21] Appl. No.: 240,968

[22] Filed: Mar. 5, 1981

[30] Foreign Application Priority Data

Mar. 5, 1980 [JP] Japan ..... 55-26676

[51] Int. Cl.³ ..... F02D 37/00

[52] U.S. Cl. ..... 123/179 G; 123/179 L; 123/179 B

[58] Field of Search ..... 123/179 L, 179 G, 179 A, 123/179 B, 179 BG, 491; 364/431.10, 431.12

[56] References Cited

U.S. PATENT DOCUMENTS 3,587,545 6/1971 Ballou ..... 123/179 A
4,100,891 7/1978 Williams ..... 123/179 G
4,250,849 2/1981 Takase ..... 123/179 L
4,266,521 5/1981 Nakano et al. ..... 123/179 L

FOREIGN PATENT DOCUMENTS 54-19021 2/1979 Japan .

*Primary Examiner*—Charles J. Myhre
*Assistant Examiner*—Andrew M. Dolinar
*Attorney, Agent, or Firm*—Antonelli, Terry & Wands

[57] ABSTRACT

A control system employs a microcomputer, which controls the starting operation of a spark ignition type engine provided with a fuel injection system. The control system is loaded with, at least, contact information of an ignition switch for connecting an ignition device to a power supply and a starter switch for connecting a starter motor to the power supply, and an output signal of a temperature sensor for detecting the temperature of cooling water of the engine. Where the cooling water temperature is not higher than a predetermined temperature, a fuel pump which supplies pressurized fuel to an injector of the fuel injection system is started simultaneously with the closure of the ignition switch, and this fuel pump is stopped during the operation of the starter motor.

7 Claims, 12 Drawing Figures

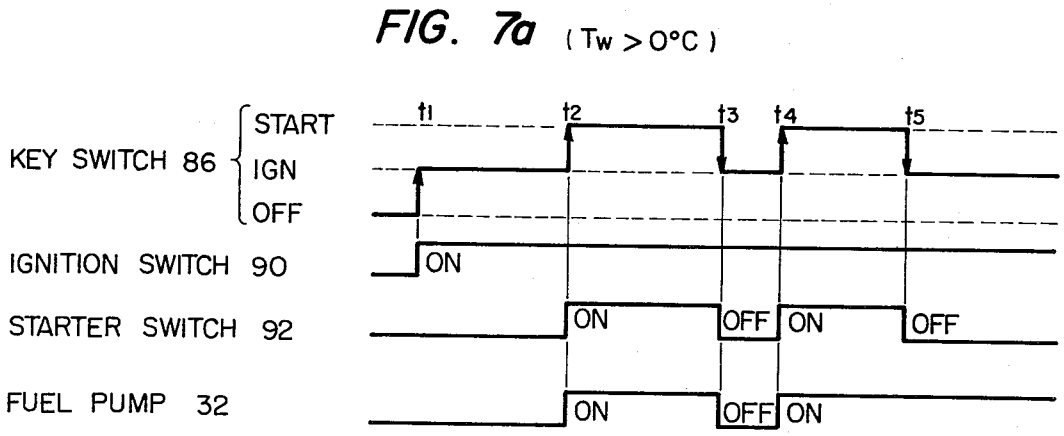
FIG. 7a ($T_w > 0°C$)
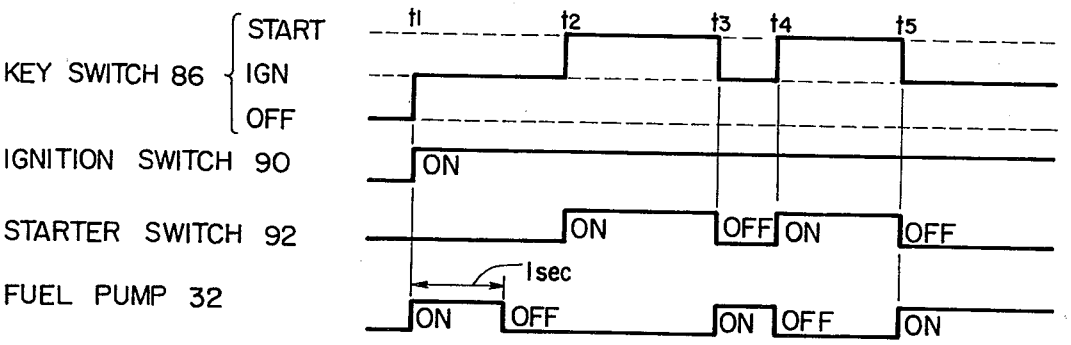
FIG. 7b ($T_w \leq 0°C$)

FIG. 7c ( Tw ≦ 0°C )
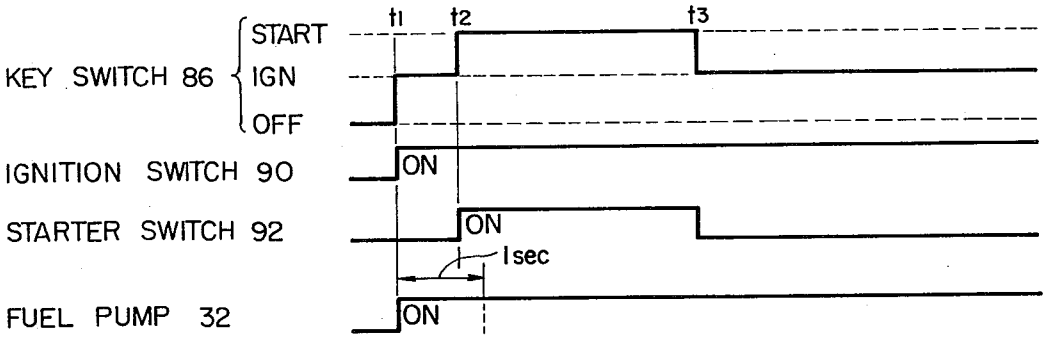

SYSTEM FOR CONTROLLING THE STARTING OPERATION OF AN INTERNAL COMBUSTION ENGINE

FIELD OF THE INVENTION

This invention relates to a system for controlling the starting operation of a spark ignition type internal combustion engine employing an injector which is supplied with fuel brought into a predetermined pressure by a fuel pump.

BACKGROUND OF THE INVENTION

The spark ignition type internal combustion engine which adopts a fuel injection system instead of a conventional carburetor has come into wide use. In such an engine, fuel whose pressure has been raised by a fuel pump is injected into an intake manifold through an injector or injectors which is/are electrically turned ON and OFF. If the pressure of the fuel is kept at a predetermined pressure related to the internal pressure of the intake manifold, the quantity of fuel to be supplied to the engine can be precisely controlled by controlling the injection time.

According to, for example, Japanese Laid-open Patent Application No. 54-19021 (1979), a pressure booster which is driven by an engine shaft is employed in addition to a low-pressure fuel pump, whereby the necessary fuel pressure is secured. Further, at the starting of the engine, the fuel is injected for the first time after the fuel pressure has reached a predetermined value.

However, in an engine in which the necessary fuel pressure is attained by a fuel pump which is driven by a battery power supply, a starter motor is connected to the battery during the starting operation, so that the battery undergoes a high load and the fuel pump is not satisfactorily driven in some cases. Especially during cold conditions, the terminal voltage of the battery is decreased greatly when the battery is subjected to the high load and, hence, it is often the case that the fuel pressure required for the starting is not attained.

SUMMARY OF THE INVENTION

An object of this invention is to provide a starting control system which can reliably start an engine even when the current supplying capability of a battery has been lowered.

Another object of this invention is to provide a starting control system which carries out a starting operation adapted to an engine temperature at the time of starting.

Still another object of this invention is to provide an engine starting control system which is appropriate for forming a part of a compact engine control system employing a microcomputer.

A further object of this invention is to provide an engine starting control system which can reliably start an engine irrespective of the skill of a starting manipulation with a key switch.

The objects of this invention as above mentioned are accomplished by a control circuit according to which when a key switch is brought into a position IGNITION ON, a fuel pump is driven for a predetermined time prior to the drive of a starter motor and, thereafter, the fuel pump is driven only in periods during which the starter motor is not driven. That is, the fuel pump is driven during periods other than periods in which a battery undergoes a high load. Therefore, the pressure of fuel can be immediately raised to a pressure necessary for starting an engine. Once the fuel pressure has been raised, this pressure is slowly decreased even when the fuel pump is stopped, unless the injection of the fuel is continuously made. Therefore, even after stopping, fuel pump the fuel is injected to crank the engine, and fuel in an amount necessary for the starting is drawn into the engine. According to a control system wherein the starting operation above described is executed only when the cooling water of the engine has a temperature equal to or lower than a set reference point given beforehand and wherein a starting operation in which the fuel pump is driven simultaneously with the drive of the starter motor is executed when the cooling water has a temperature higher than the set reference point, a reliable and practical engine starting dependent upon the temperature becomes possible.

DESCRIPTION OF THE PREFERRED EMBODIMENT

Figure 1:
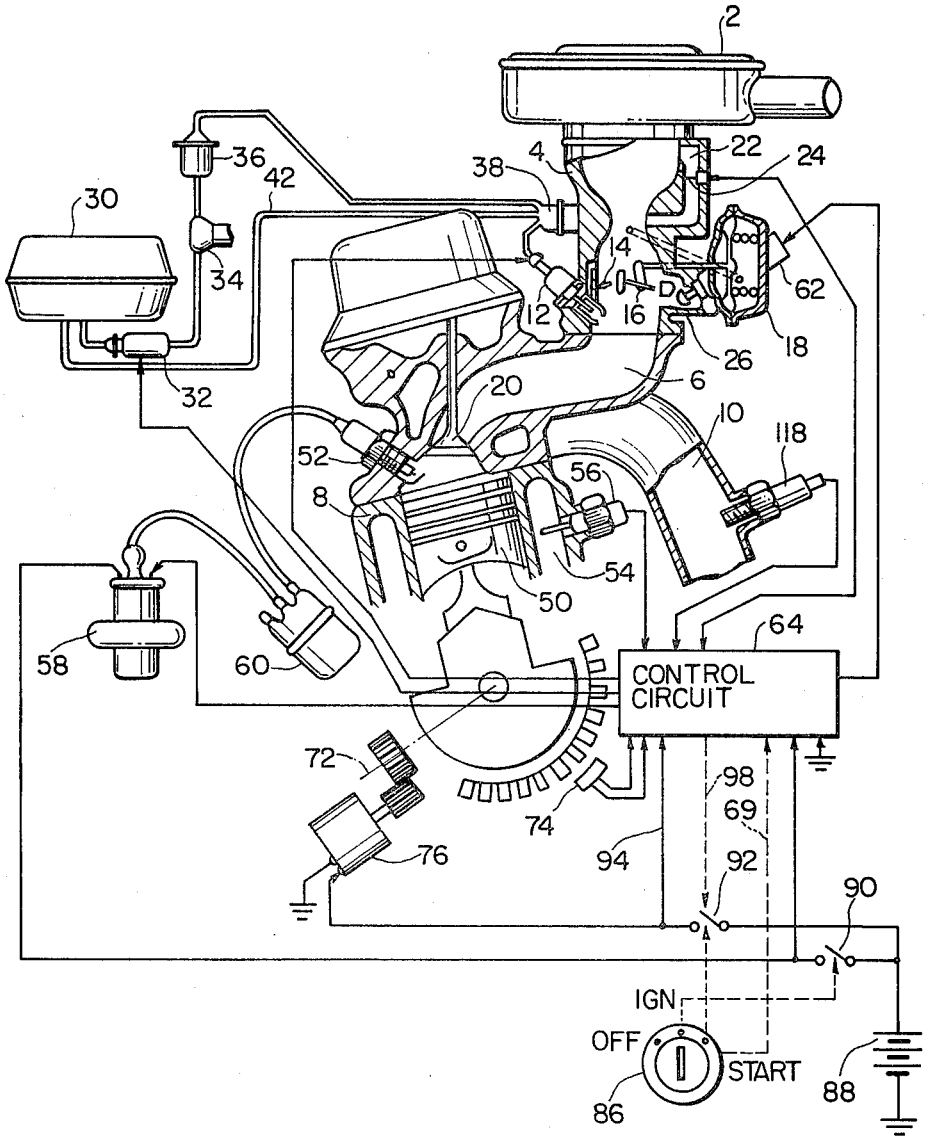
FIG. 1 is a block diagram showing an embodiment of this invention.

An embodiment of this invention will be described with reference to FIG. 1 which is a system diagram of an electronic engine control apparatus.

Air is drawn into a throttle chamber 4 through an air cleaner 2. Fuel is injected from an injector 12 which is disposed downstream of a throttle valve 14 interlocked with an accelerator pedal. The mixture consisting of air and fuel vapor is drawn into a cylinder 8 through an intake manifold 6 and an intake valve 20. When the flow rate of the air drawn in has increased, a diaphragm 18 operates owing to an increase in the negative pressure of the throttle chamber 4, and a throttle valve 16 is opened, so that an increase in the intake resistance of the air is suppressed. The upper stream side of the throttle valves 14 and 16 is in the shape of a Venturi tube, and the air flow rate to be drawn into an engine is measured by a hot wire type air flow sensor 24 which is disposed in a bypass air passage 22 open to the narrowest part of the Venturi tube.

The fuel is supplied from a fuel tank 30 through a fuel damper 34, a fuel filter 36 and a fuel pressure regulator 38 to the injector 12 by means of a fuel pump 32. In the fuel pressure regulator 38, the flow rate of fuel to be fed back to the fuel tank 30 through a return pipe 42 is regulated so that the difference between the pressure of fuel to be supplied to the injector 12 and the internal pressure of the intake manifold 6 may become constant.

The mixture which is drawn from the intake valve 20 into the cylinder 8 undergoes a compression process, and is thereafter ignited to burn. A gas produced by the combustion pushes down a piston 50, and is thereafter emitted through an exhaust valve not shown and an exhaust pipe 10. The concentration of oxygen $O_2$ in the gas is detected by a λ sensor 118. On the other hand, the temperature of cooling water 54 for cooling the cylinder 8 is detected by a temperture sensor 56. In addition, a REF pulse indicating that an engine shaft 72 lies at a reference angle, and a POS pulse indicating that it has rotated a unit angle (1 degree) are generated from an angle sensor 74. Electric signals from the temperature sensor 56, the angle sensor 74, the λ sensor 118 and the air flow sensor 24 are applied to a control circuit 64 which is constructed of a microcomputer etc.

When a key switch 86 is brought into a position IGN, an ignition switch 90 is turned ON, whereby the control circuit 64 starts operating and simultaneously the primary side of an ignition coil 58 is supplied with the voltage of battery 88. Current which flows through the primary side of the ignition coil 58 is interrupted in accordance with the rotation of the engine by means of the control circuit 64. Sparks are generated from an ignition plug 52 by a high voltage generated on the secondary side of the ignition coil 58 and distributed by a distributor 60.

When the key switch 86 is brought into a position START, both the ignition switch 90 and a starter switch 92 turn ON. Thus, a starter motor 76 is driven to crank the engine. Whether or not the starter motor 76 is driven is transmitted to the control circuit 64 through a line 94.

When the key switch 86 lies at a position OFF, both the ignition switch 90 and the starter switch 92 turn OFF, and the engine stops.

Dotted lines 69 and 98 show an embodiment different from the foregoing embodiment, in which the starter switch 92 is turned ON and OFF directly by the key switch 86. In the different embodiment, whether or not the AND condition holds between the fact that the key switch 86 lies at the position START, and another condition, for example, the fact that the engine is not self-cranking is decided by the control circuit 64. Only when the AND condition holds, the starter switch 92 is turned ON.

All of the opening or closure of the injector 12, the amount of lift of a bypass valve 62 disposed in an air passage 26 bypassing the throttle valve 16, and the drive or stop of the fuel pump 32 are controlled by the control circuit 64.

Figure 2:
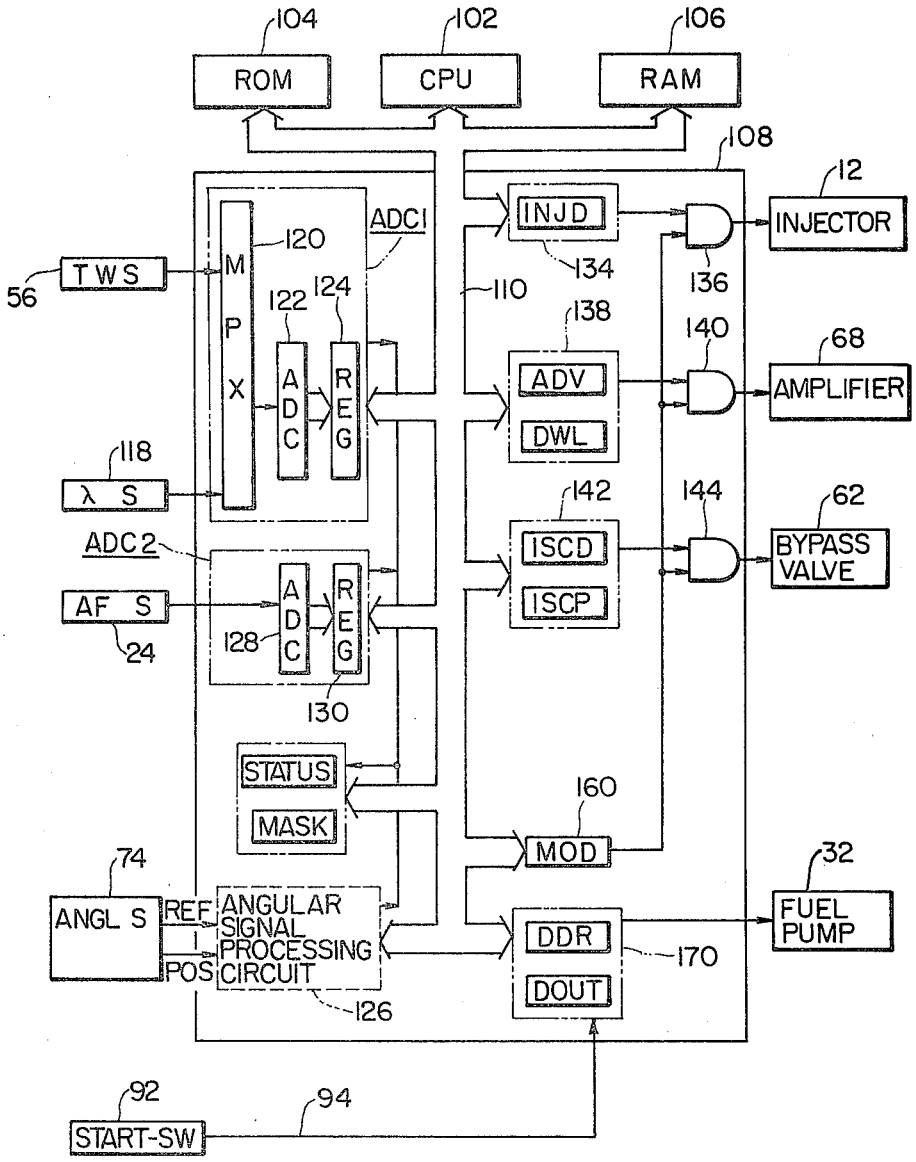
FIG. 2 is a block diagram showing the arrangement of a control circuit (64) in FIG. 1.

Referring now to FIG. 2, the arrangement of the control circuit 64 will be described. The control circuit 64 is constructed of a CPU 102, a read only memory 104 (hereinbelow, written "ROM"), a random access memory 106 (hereinbelow, written "RAM") and an input-/output circuit 108. The CPU 102 operates on input data from the input/output circuit 108 and returns the operated results to the input/output circuit 108 again in accordance with various programs stored in the ROM 104. For temporary storage necessary for these operations, the RAM 106 is used. The exchanges of various data among the CPU 102, the ROM 104, the RAM 106 and the input/output circuit 108 are made with a bus line 110 which consists of a data bus, a control bus and an address bus.

The input/output circuit 108 has the input means of a first analog-to-digital converter (hereinbelow, written "ADC1"), a second analog-to-digital converter (hereinbelow, written "ADC2"), an angular signal processing circuit 126 and a discrete input/output circuit 170 (hereinbelow, written "DIO") for receiving and delivering 1-bit information.

The ADC1 receives outputs of the sensors of the temperature sensor 56 (hereinbelow, written "TWS") for detecting the cooling water temperature, the λ sensor 118, etc., and selects one of them by means of a multiplexer 120. The selected signal converted into a digital value by an analog-to-digital converter circuit 122 (hereinbelow, written "ADC") is held in a register 124 (hereinbelow, written "REG").

An output of the air flow sensor 24 (hereinbelow, written "AFS") is applied to the ADC2, and is set in a register 130 (hereinbelow, written "REG") after digital coversion by an analog-to-digital converter circuit 128 (hereinbelow, written "ADC").

The REF pulse and POS pulses generated from the angle sensor 74 (hereinbelow, written "ANGS") are applied to the angular signal processing circuit 126. Here, they are waveshaped, and the number of the POS pulses within a predetermined time is counted to calculate the speed of the engine.

A contact information of the starter switch 92 which indicates the energization status of the starter motor 76 is loaded into the an input/output data storage (DIO) 170. The DIO 170 is provided with a register DDR for determining whether its terminal is to be used as an input terminal or as an output terminal, and a register DOUT for latching output data. A pulse signal for turning ON and OFF a switch (not shown) which drives and stops the fuel pump 32 is provided from the register DOUT.

An injector control circuit 134 is a circuit which converts into a pulse output the quantity of fuel injection calculated by the CPU 102. More specifically, a pulse signal of a pulse width which corresponds to the quantity of fuel injection set in a register INJD is delivered at a timing related with the REF pulse, and it is applied to the injector 12 through an AND gate 136.

A bypass valve control circuit 142 has two registers ISCD and ISCP in which values are set by the CPU 102. It forms a pulse signal which has a pulse width corresponding to the data set in the register ISCD and a recurrence period corresponding to the data set in the register ISCP. The amount of lift of the bypass valve 62 depends upon the duty ratio of the pulse signal which is delivered through an AND gate 144.

Figure 3:
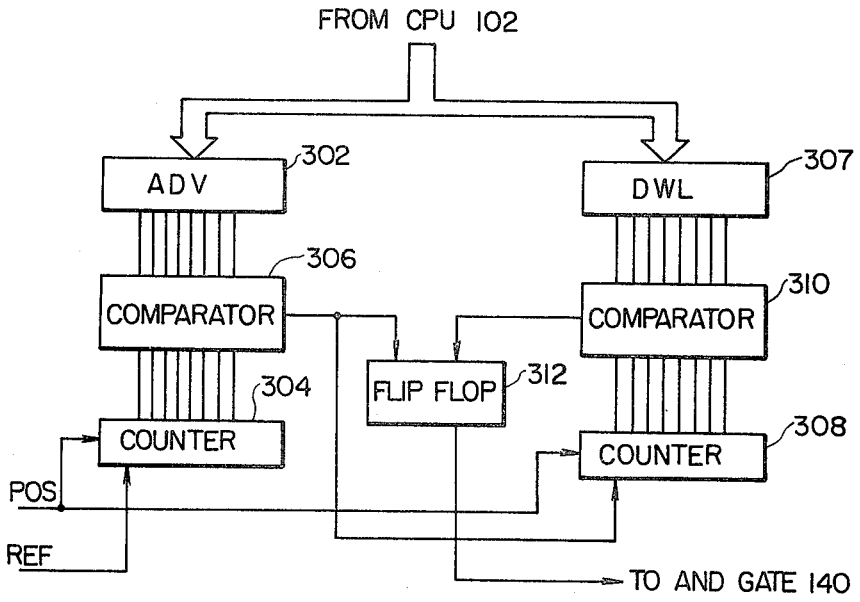
FIG. 3 is a circuit diagram showing the arrangement of a block (138) in FIG. 2, FIGS. 4*a* to 4*d* are time charts showing the operations of a few parts in FIG. 3.
Figures 4A, 4B, 4C, 4D:
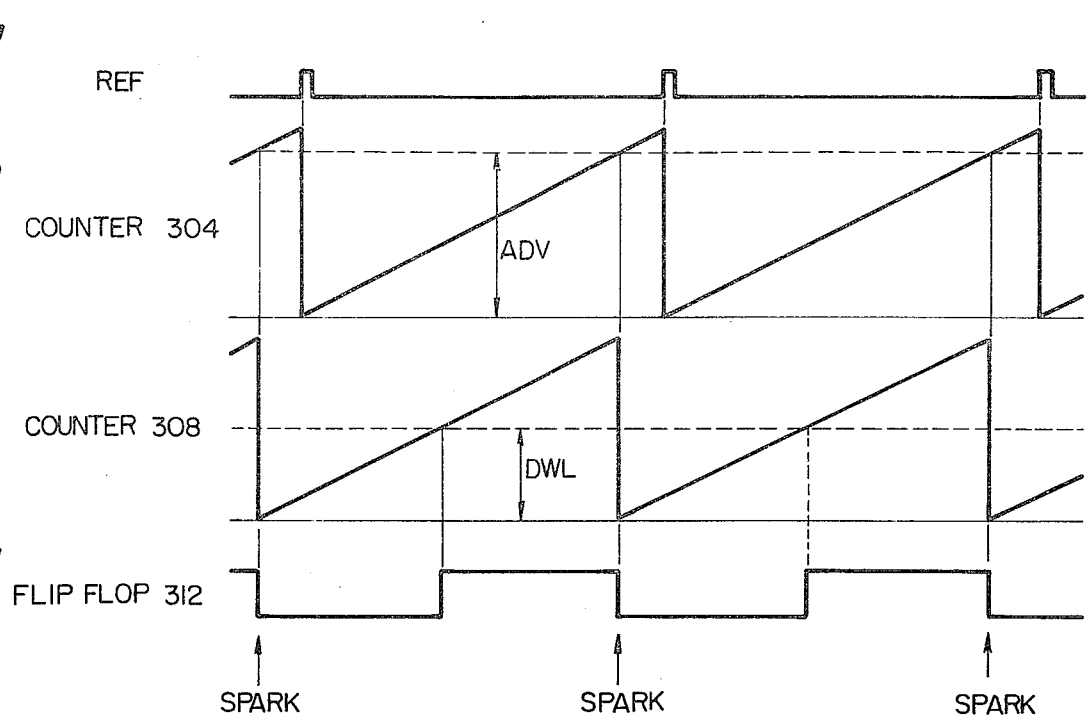

An ignition pulse generator circuit 138 is shown in detail in FIG. 3. It will now be described with reference to a time chart in FIG. 4. An ignition advance angle calculated by the CPU 102 is set in a register 302. In a counter 304, the POS pulses each being generated by the engine shaft rotation of 1 degree are counted at all times. The count value is cleared each time the REF pulse at a in FIG. 4 is generated. The REF pulse is generated each time each cylinder of the engine reaches its top dead center, and in case of a 4-cylinder engine, it is generated each time the engine shaft rotates 180°. When the count value of the counter 304 coincides with the value indicative of the ignition advance angle of the engine as set in the register 302, a coincidence output is provided from a comparator 306 and resets a flip-flop 312. Simultaneously therewith, another counter 308 for counting the POS pulses is cleared. In a register 307, a dwell angle calculated by the CPU 102 is set. When the value of the counter 308 coincides with the set value, a coincidence output is provided from a comparator 310 and resets the flip-flop 312. An output pulse of the flip-flop 312 as shown at d in FIG. 4 is applied through an AND gate 140 to an amplifier 68 which controls the conduction time interval of the primary side of the ignition coil 58. At the fall of the output pulse of this flip-flop 312, a spark is generated by the ignition plug 52.

Referring again to FIG. 2, a register 160 is a register (hereinbelow, written "MOD") which holds therein instructions directive of various statuses in the input-/output circuit 108. For example, all the AND gates 136, 140, and 144 are turned ON or OFF by setting an instruction in this register 160. By setting instructions in the MOD register 160 in this manner, the outputs of the injector control circuit 134, the bypass valve control circuit 142 and the ignition pulse generator circuit 138 can be inhibited.

Figure 5:
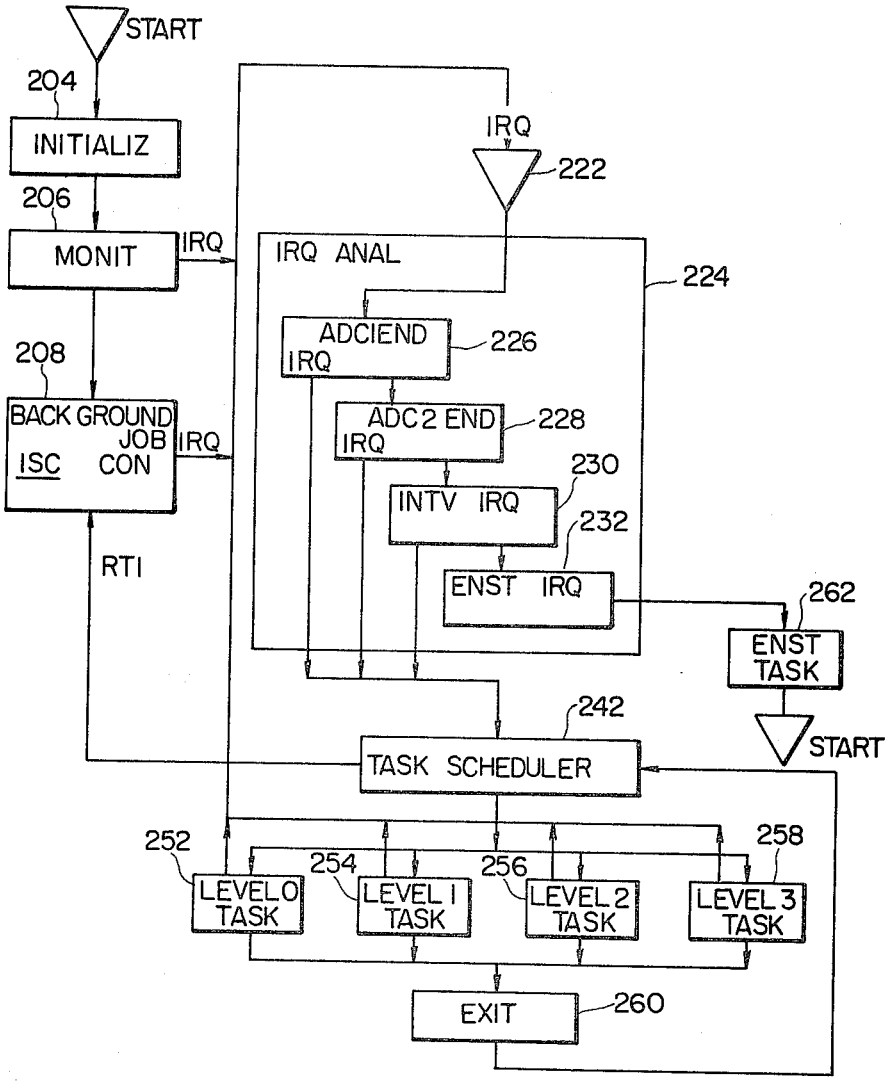
FIG. 5 is a flow chart showing a program system for operating the circuit of FIG. 2.

FIG. 5 is a diagram which shows a program flow chart for operating the control circuit 64 in FIG. 2.

When the key switch 86 shown in FIG. 1 is brought into a position ON, the ignition switch 90 turns ON, whereby the CPU 102 falls into a start mode. First, an initialize program 204 is executed.

The initialize program 204 is a program which serves to perform preprocessing operations for actuating the microcomputer. For example, it clears the stored content of the RAM 106, sets the initial values of the registers of the input/output interface circuit 108, and carries out processing operations for loading input information such as data of the cooling water temperature TW for executing preprocessing operations necessary for making the engine control.

Subsequently, a monitor program (MONIT) 206 is executed, and a background job (BACKGROUND JOB) 208 is executed. The background job is, for example, a valve opening rate-control task (hereinbelow, written "ISC CON") for the bypass valve 62. When an interrupt request (hereinbelow, written "IRQ") has occurred during the execution of this task, an IRQ factor-analyzing program 224 (hereinbelow, written "IRQ ANAL") is executed from an interrupt processing start point 222.

The program IRQ ANAL consists of a program 226 for the end interrupt request of the ADC1 (hereinbelow, written "ADC1 END IRQ"), a program 228 for the end interrupt request of the ADC2 (hereinbelow, written "ADC2 END IRQ"), a program 230 for a fixed interval lapse-interrupt request (hereinbelow, written "INTV IRQ") and a program 232 for an engine stop-interrupt request (hereinbelow, written "ENST IRQ"). It affords start requests (hereinbelow, written "QUEUE") to tasks requiring starts, respectively.

A task scheduler 242 determines the sequence of execution of task groups so as to first execute the task group of a higher level (here, the level zero being the highest) between the task group generating the QUEUE and the task group interrupted from execution. When the execution of the task group has ended, the end is reported by an end report program 260 (hereinbelow, written "EXIT"). Upon this end report, a task of the highest level in the task group waiting for execution is subsequently executed.

When the task group interrupted from execution and the task group generating the QUEUE have become nonexistent, the execution of the CPU 102 shifts from the task scheduler 242 to the background job 298 again. Further, when the IRQ has occurred during the execution of either a level 0 (zero) task or a level 3 (three) task, the control returns to the start point 222 of the IRQ processing program.

When an engine stop interrupt has occurred, an engine stop processing task (hereinbelow, written "ENST TASK") 262 is started. When the ENST TASK 262 has been executed, the control system reaches the start mode and returns to the start point 202 again.

Figure 6:
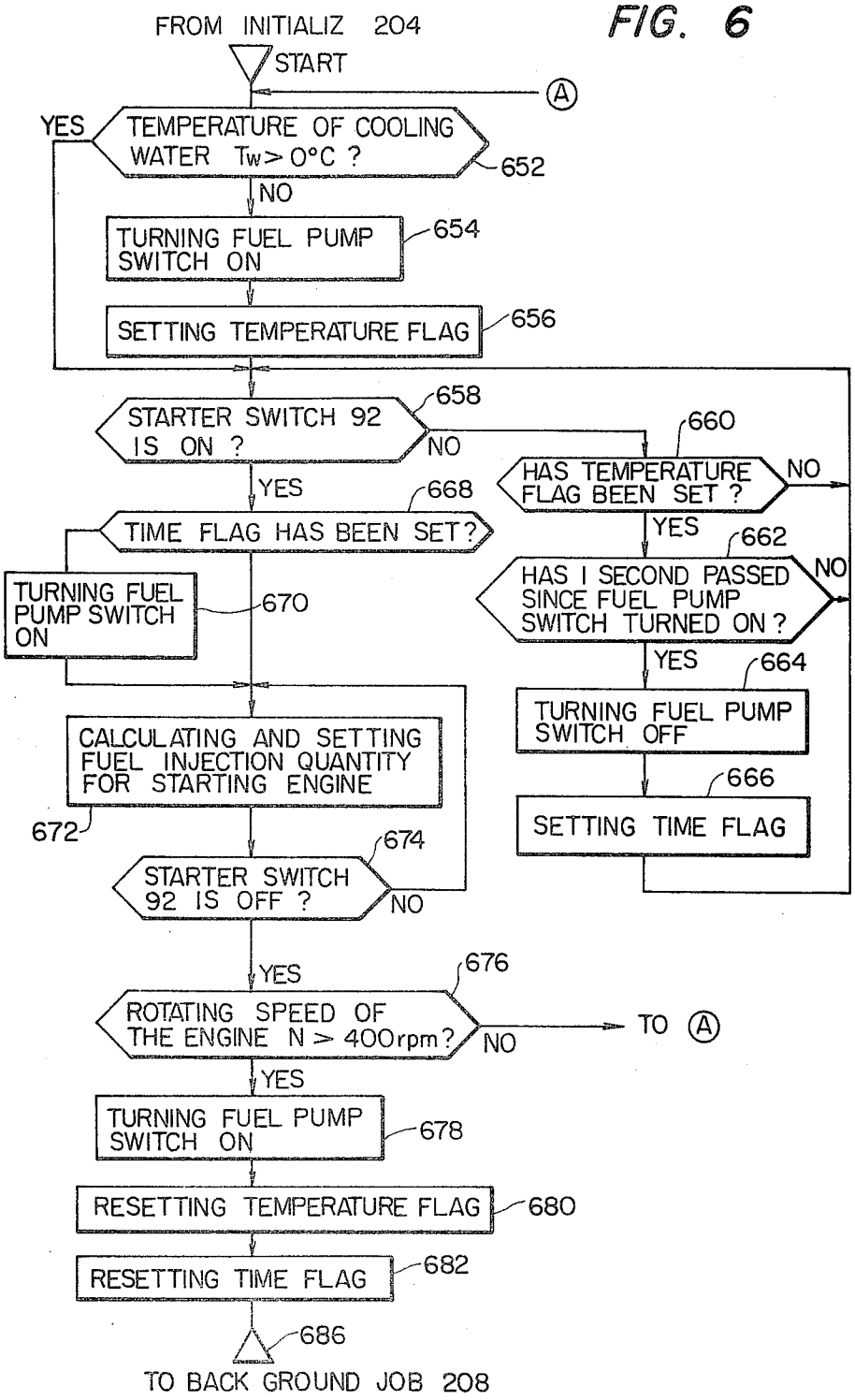
FIG. 6 is a flow chart showing a program (206) in FIG. 5, and FIGS. 7*a* to 7*c* are time charts showing the operations of the embodiment of FIG. 1.

The monitor program 206 stated before is a program for controlling the starting operation of the engine, and its detailed flow is illustrated in FIG. 6. First, at a step 652, whether or not the engine cooling water temperature Tw is higher than a set reference temperature 0° C. is decided on the basis of the water temperature data loaded from the temperature sensor 56. Where the engine cooling water temperature Tw is higher than the set reference temperature 0° C., the flow jumps to a step 658. Where the engine cooling water temperature Tw is not higher than 0° C., the flow shifts to a step 654 where a fuel pump switch (not shown) is turned ON. At the next step 656, a temperature flag provided in the RAM 106 is set. Here, the "temperature flag" is a flag for deciding that the engine cooling water temperature is not higher than the set reference point.

Further, at the next step 658, it is decided whether or not the starter switch 92 has been turned ON. If the starter switch 92 is in the ON state, the flow shifts to a step 668. On the other hand, if the starter switch 92 is in the OFF state, the flow shifts to a step 660. At the step 660, it is judged whether or not the temperature flag provided in the RAM 106 has been set, in other words, whether or not the engine cooling water temperature has been decided to be 0° C. or below. Where, at the step 660, it has been judged that the temperature flag has not been set, the flow returns to the step 658. On the other hand, where the temperature flag has been set, the flow proceeds to a step 662. At the step 662, whether or not one second has elapsed since the turning-ON of the fuel pump switch is judged. This is because, in the case where the temperature flag has been decided to be set at the step 660, it has already been decided at the step 652 that the engine cooling water temperature Tw is not higher than 0° C., and the fuel pump switch has been put into the ON state at the step 654, so the fuel pump 32 has already been driven. At this step 662, it is judged whether or not the time required for attaining a predetermined fuel pressure (2 kg/cm$^2$) necessary for starting the engine has elapsed. Where the operating time of the fuel pump 32 has not continued for one second, the control shifts to the step 658. Where it has continued for one second, the control shifts to a step 664. At the step 664, the fuel pump switch is turned OFF to stop the operation of the fuel pump 32, and the control simultaneously shifts to a step 666. The step 666 sets a time flag provided in the RAM 106, and shifts to the step 658. Here, the "time flag" is a flag for deciding that the fuel pump has operated for a predetermined time (one second in this embodiment).

On the other hand, where it has been decided at the step 658 that the starter switch 92 is ON, the flow shifts to a step 268 which judges whether or not the time flag has been set. Where it has been decided at the step 668 that the time flag has been set, in other words, where the engine cooling water temperature Tw is not higher than 0° C. and, in addition the fuel pump 32 has operated for the predetermined time, the control shifts to a step 672. Where it has been decided at the step 668 that the time flag has not been set, in other words, where the engine cooling water temperature is higher than 0° C. or where the engine cooling water temperature is not higher than 0° C. and where the starter switch 92 has been turned ON before the fuel pump 32 has been operated for the predetermined time, the flow shifts to a step 670 at which the fuel pump switch is turned ON, and which is followed by the step 672. At the step 672, the fuel injection quantity or fuel injection time necessary for the starting is calculated. Further, at the next step 674, it is judged whether or not the starter switch 92 has been turned OFF. Where the starter switch 92 has not been turned OFF or is in the ON state, the flow returns to the step 672 where the fuel injection time at the starting is calculated again. Where it has been decided at the step 674 that the starter switch 92 is in the OFF state, the control shifts to a step 676 which judges whether or not the number of revolutions N of the engine is greater than 400 r.p.m., in other words, whether or not the engine has begun to self-crank. Where it has been decided at the step 676 that the engine is not self-cranking, the control returns to the step 652 and the processing operations as above stated are carried out. In contrast, where it has been decided at the step 676 that the engine is self-cranking, the flow shifts to a step 678 at which step the fuel pump switch is turned ON again to restart the fuel pump 32. At steps 680 and 682, the temperature flag and the time flag are respectively reset. Thus, the execution of the monitor program 206 has ended, and it shifts to the execution of the background job 208 in FIG. 5.

The starting operation which is effected by the execution of the above monitor program by the control circuit 64 is illustrated in time charts of FIGS. *7a* to *7c*.

FIG. *7a* corresponds to the case where the cooling water temperature Tw is higher than 0° C. being the set reference point. In this case, the fuel pump 32 is driven when the starter switch 92 has been turned ON as at a time $t_2$, not when the ignition switch 90 has been turned ON. When the starter switch 92 is turned OFF at a time $t_3$ to stop the starter motor 76 and the engine is not self-cranking yet, the fuel pump 32 stops simultaneously. If the engine has begun to self-crank at a time $t_5$, the fuel pump 32 continues its operation. Here, the "set reference temperature" signifies an engine temperature at which even when the starter motor and the fuel pump are simultaneously driven, the terminal voltage of the battery is not lowered considerably and the predetermined fuel pressure (for example, 2 kg/cm$^2$) necessary for starting the engine can be immediately attained.

FIG. *7b* illustrates the case where the cooling water temperature Tw is not higher than the set reference point. In this case, when the ignition switch 90 is turned ON at a time $t_1$, the fuel pump 32 is immediately started and is driven for one second. Owing to this operation of the fuel pump for one second, the pressure of the fuel fed to the injector 12 is raised enough to start the engine. Even when the starter switch 92 is turned ON at a time $t_2$, the fuel pump 38 is not driven. Thereafter, only when the starter switch 92 is turned OFF as at a time $t_3$, in other words, while the starter motor 76 is stopped, is the fuel pump 38 driven.

In such a starting operation, the fuel pump is driven during intervals other than the periods during which the starter motor 76 is driven to exert a high load on the battery 88, so that the pressure of the fuel can be quickly raised to the pressure required for the starting. Accordingly, even when the current supplying capability of the battery has been lowered, the engine can be reliably started.

FIG. *7c* illustrates the case where the key switch 86 has been changed-over from the position OFF to the position IGN at a time $t_1$, whereupon it has been changed-over from the position IGN to the position START at a time $t_2$ before the elapse of one second. In this case, even when the starter switch 92 has been turned ON to drive the starter motor 76 at the time $t_2$, the fuel pump 32 is continuously driven without being stopped. In the case where the starter motor 76 has been started before the drive of the fuel pump 32 previous to the drive of the starter motor 76 has not continued for the set time (one second), there is the fear that the pressure of the fuel has not reached the pressure sufficient for the engine starting yet, and hence, the fuel pump 32 is continuously driven as described above.

In this manner, according to the control circuit 64 which executes the flow chart shown in FIG. 6, the starting operation adapted to the engine temperature at the starting is performed. In addition, the engine is reliably started irrespective of the skill of the manipulation of the key switch 86.

We claim:

1. A system for controlling the starting of an engine, comprising:

manipulation means including at least first and second contacts, ignition means adapted to be connected to a power supply by said first contact, a starter motor which is adapted to be connected to said power supply by said second contact, a fuel injection system which includes an injector to be turned ON and OFF by electrical control, and a fuel pump for supplying pressurized fuel to said injector, a temperature sensor which detects the temperature of a coolant of the engine, and a control circuit to which said first and second contacts and said temperature sensor are connected, which drives said fuel pump from a point of time of turning-ON of said first contact and at least during a period of turning-OFF of said second contact and does not drive said fuel pump during any period of turning-ON of said second contact in case where, in a starting operation of said engine, the temperature of the coolant indicated by an output signal of said temperature sensor is not higher than a predetermined reference temperature, and which drives said fuel pump at least during any period of turning-ON of said second contact in case where the temperature of said coolant is higher than said reference temperature.

2. A system for controlling the starting of an engine as defined in claim 1, wherein said control circuit can limit within a predetermined time a continuous drive time of said fuel pump during said period during which said second contact is turned OFF.

3. A system for controlling the starting of an engine as defined in claim 1, wherein said control circuit drives said fuel pump continuously when a period during which said first contact is turned ON and said second contact is turned OFF is shorter than a predetermined time.

4. A system for controlling the starting of an engine, comprising:

switch means having at least first, second and third statuses, ignition means adapted to be connected to a power supply when said switch means is in said second and third statuses, and to be disconnected from said power supply when said switch means is in said first status, a starter motor which is adapted to be connected to said power supply under at least a condition that said switch means is in said third status, and which is disconnected from said power supply when said switch means is in said first and second statuses, a fuel injection system which includes an injector to be turned ON and OFF by electrical control, and a fuel pump for supplying pressurized fuel to said injector, a temperature sensor which detects the temperature of a coolant of the engine, and a control circuit to which outputs of said switch means and said temperature sensor and a conduction situation of said starter motor are transmitted, and which initiates driving of said fuel pump during a period of non-conduction of said starter motor in a time interval after said switch means has been changed-over from said first status into said second status when the temperature of the coolant indicated by the output of said temperature sensor is not higher than a predetermined reference temperature, and which initiates driving of said fuel pump during a period of conduction of said starter motor when the temperature of said coolant is higher than said predetermined reference temperature.

5. A system for controlling the starting of an engine as defined in claim 4, wherein said control circuit can limit a continuous drive time of said fuel pump within a predetermined time.

6. A system for controlling the starting of an engine as defined in claim 4, wherein said control circuit can limit a continuous drive time of said fuel pump when said second status continues longer than a predetermined time.

7. A system for controlling the starting of an engine, comprising:

manipulation means including at least first and second contacts, ignition means adapted to be connected to a power supply by said first contact, a starter motor which is adapted to be connected to said power supply by said second contact, a fuel injection system which includes an injector to be turned ON and OFF by electrical control, and a fuel pump for supplying pressurized fuel to said injector, a temperature sensor which detects the temperature of a coolant of the engine, and a control circuit which loads thereinto at least statuses of said first and second contacts and an output of said temperature sensor, and which includes at least input/output means to generate outputs for controlling start and stop of said fuel pump and memory means having areas for setting first and second flags therein, said control circuit including the following operating steps:

(a) the first step of starting said fuel pump and simultaneously setting said first flag when said first contact has been turned ON, and when the output indicated by said temperature sensor is not higher than a predetermined reference temperature, (b) the second step of deciding whether or not said second contact is turned ON, (c) the third step of proceeding only when said second contact is turned OFF and said first flag is set, monitoring lapse of a predetermined time since the drive of said fuel pump, and stopping said fuel pump and besides setting said second flag when said predetermined time has lapsed, (d) the fourth step of proceeding when said second contact is turned ON, and deciding whether or not said second flag is set, (e) the fifth step of starting said fuel pump in case where it has been decided at said fourth step that said second flag is not set, (f) the sixth step of monitoring the turning-OFF of said second contact, and (g) the seventh step of deciding whether or not said engine is self-cranking when said second contact has been turned OFF at said sixth step, and restarting said fuel pump if said fuel pump has been stopped at said third step and simultaneously resetting said first and second flags in case where said engine is self-cranking.

* * * * *